United States Patent [19]

Herold et al.

[11] Patent Number: 5,076,166

[45] Date of Patent: Dec. 31, 1991

[54] ARRANGEMENT FOR THE ACCURATELY POSITIONED QUICK-ACTION CLAMPING AND TENSIONING OF PRINTING PLATES

[75] Inventors: Manfred Herold, Kahl; Herbert Rebel, Rodgau; Roland Höll, Weiterstadt, all of Fed. Rep. of Germany

[73] Assignee: Man Roland Druckmaschinen AG, Offenback am Main, Fed. Rep. of Germany

[21] Appl. No.: 606,698

[22] Filed: Oct. 31, 1990

[30] Foreign Application Priority Data

Nov. 2, 1989 [DE] Fed. Rep. of Germany ..... 3936458

[51] Int. Cl.[5] ..... B41F 1/30

[52] U.S. Cl. ..... 101/415.1

[58] Field of Search ..... 101/409, 415.1, 378

[56] References Cited

U.S. PATENT DOCUMENTS

| | | | |
|---|---|---|---|
| 4,120,244 | 10/1978 | Wirz | 101/409 |
| 4,191,106 | 3/1980 | Fermi et al. | 101/415.1 |
| 4,506,602 | 3/1985 | Sugiyama et al. | 101/409 |
| 4,712,476 | 12/1987 | Jeschue | 101/415.1 |
| 4,893,561 | 1/1990 | Grosshauser et al. | 101/378 |
| 5,003,878 | 4/1991 | Dorow et al. | 101/415.1 |

*Primary Examiner*—Eugene H. Eickholt

*Attorney, Agent, or Firm*—Leydig, Voit & Mayer

[57] ABSTRACT

An arrangement for the accurately positioned quick-action clamping and tensioning of printing plates on a plate cylinder (1). Clamping tools (14) are disposed in frame walls (2) and, after appropriate positioning of the plate cylinder, are engageable in coupling sleeves (12) on camshafts (4.3, 5.3) of front and rear tensioning bars (4, 5) by the application of pressure medium (15, 16, 17, 18). Clamping and unclamping is then effected by turning the clamping tools (14) via levers (20) and compressed air cylinders (23). A compressed air motor (25) is disposed in the cylinder gap (3) for tensioning purposes.

9 Claims, 8 Drawing Sheets

ARRANGEMENT FOR THE ACCURATELY POSITIONED QUICK-ACTION CLAMPING AND TENSIONING OF PRINTING PLATES

BACKGROUND OF THE INVENTION

The invention relates to an arrangement for the accurately positioned quick-action clamping and tensioning of printed plates on a plate cylinder of a printing machine.

In such a machine, the cylinder carries front and rear tensioning bars each having a clamping device for clamping a printing plate. Camshafts are associated with the clamping devices and, upon being rotated, are operable to actuate the clamping devices.

An arrangement of this general type is known from DE-PS 3 516 682 and, in a known manner, allows the printing plate to be clamped at the start and end of the print by turning of the camshafts associated with the corresponding tensioning bars, using a manually actuated tool. Subsequent tensioning of the printing plate is then also carried out manually by means of a tool, the tensioning bar at the print end being moved from the rear gap wall substantially circumferentially by way of a central actuating device and a pressure strip. A disadvantage of this system is that a number of manual operations are required at the cylinder gap and automatic retensioning during machine operation is not guaranteed.

DE-OS 3 843 433 describes a system for the quick-action tensioning of printing plates, the camshafts which effect clamping and tensioning being provided with double cam followers at each of the cylinder side walls and being turnable, for clamping, unclamping, tensioning, and releasing, via an actuating device fixed to the frame, after the plate cylinder has been positioned to the appropriate angle.

A technically similar way is also described by EP-A2 0 260 492, in which the camshafts at the cylinder side walls carry single lever arms instead of double lever arms and are turnable by tension or pressure via an actuating device on the frame side.

A disadvantage of both solutions is that tensioning of the printing plate can be carried out only in a specific position of the plate cylinder and there is no guarantee of re-tensioning during operation of the machine, and particularly there is no guarantee of automatic retensioning. There are also negative effects on the clamping and tensioning state due to the double or single levers which also rotate and also require room, and this is due particularly to the impacts as the plate gap and the blanket cylinder gap roll on and off one another.

Another system for accurately positioned quick-action tensioning is shown in DE-OS 3 843 395. According to this, at least one common actuating device disposed on the machine front is associated with the clamping and tensioning system, such actuating device corresponding to the angular position of the plate cylinder at the time of clamping and tensioning. Clamping and tensioning are effected via axially movable draw key transmissions which are movable by the actuating devices disposed on either side of the cylinder side walls. Here again tensioning is not possible during machine operation. Another disadvantage is that the forces for clamping, unclamping, tensioning and releasing always act axially and must therefore be taken by the plate cylinder bearings.

SUMMARY OF THE INVENTION

The general object of the invention is to develop an arrangement of the above general type so as to allow clamping and tensioning of the printing plate with a minimum of handling while giving the exactly required positions, control of the tension of printing plates and their automatic retensioning being possible uniformly over the entire width, particularly in the case of large-format printing plates, while obviating the disadvantages referred to in the prior art.

A more detailed object of the invention is to achieve the foregoing through the provision of an arrangement in which tools for rotating the camshafts of the clamping devices are automatically advanced into coupling relationship with the camshafts when the print cylinder is in a predetermined angular position and then are automatically rotated to effect actuation of the clamping devices.

The invention also resides in the provision of a relatively simple and compact mechanism for advancing and rotating the tools.

These and other objects and advantages of the invention will become more apparent from the following detailed description when taken in conjunction with the accompanying drawings.

FIGS. *2a* and *2b* are enlarged details of the clamping device on one side of the frame.

Figure 3:
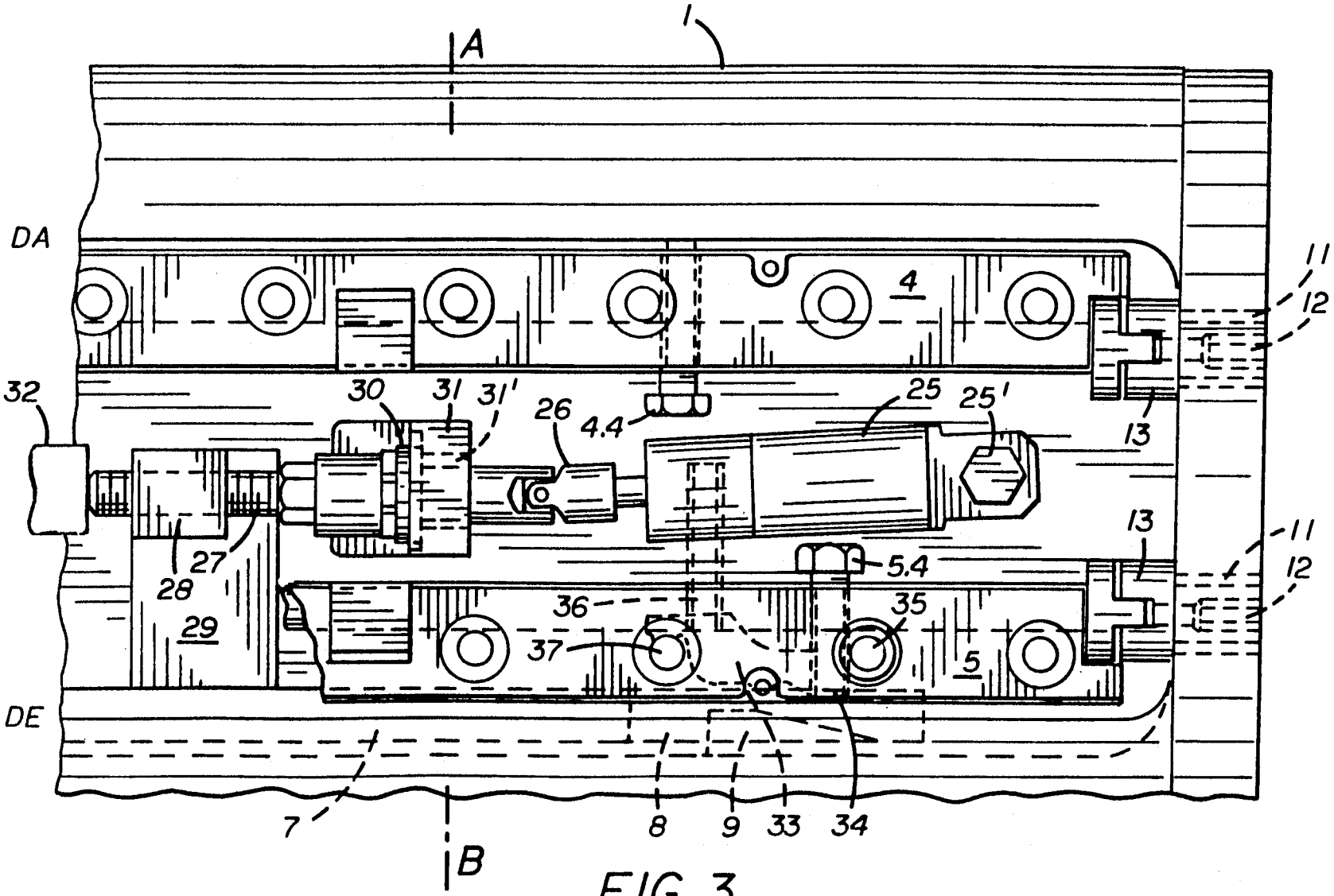

FIG. 3 is a view of the plate cylinder with the tensioning device drive.

Figure 4:
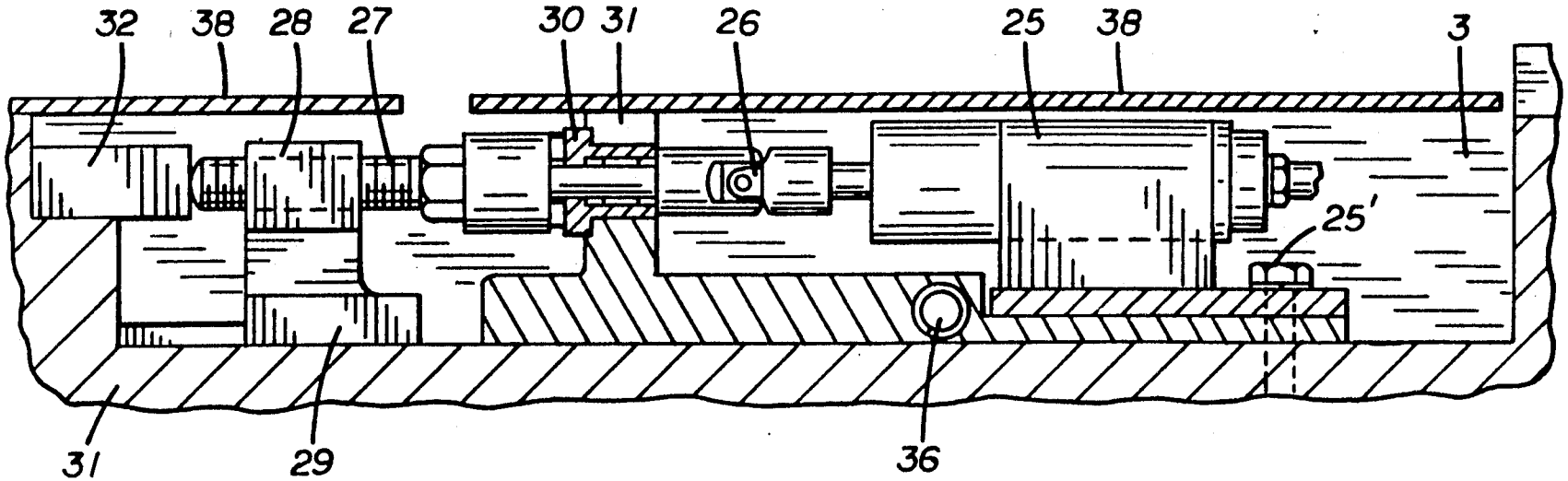

FIG. 4 is an enlarged longitudinal section through the middle of the gap of the printing cylinder.

Figure 5:
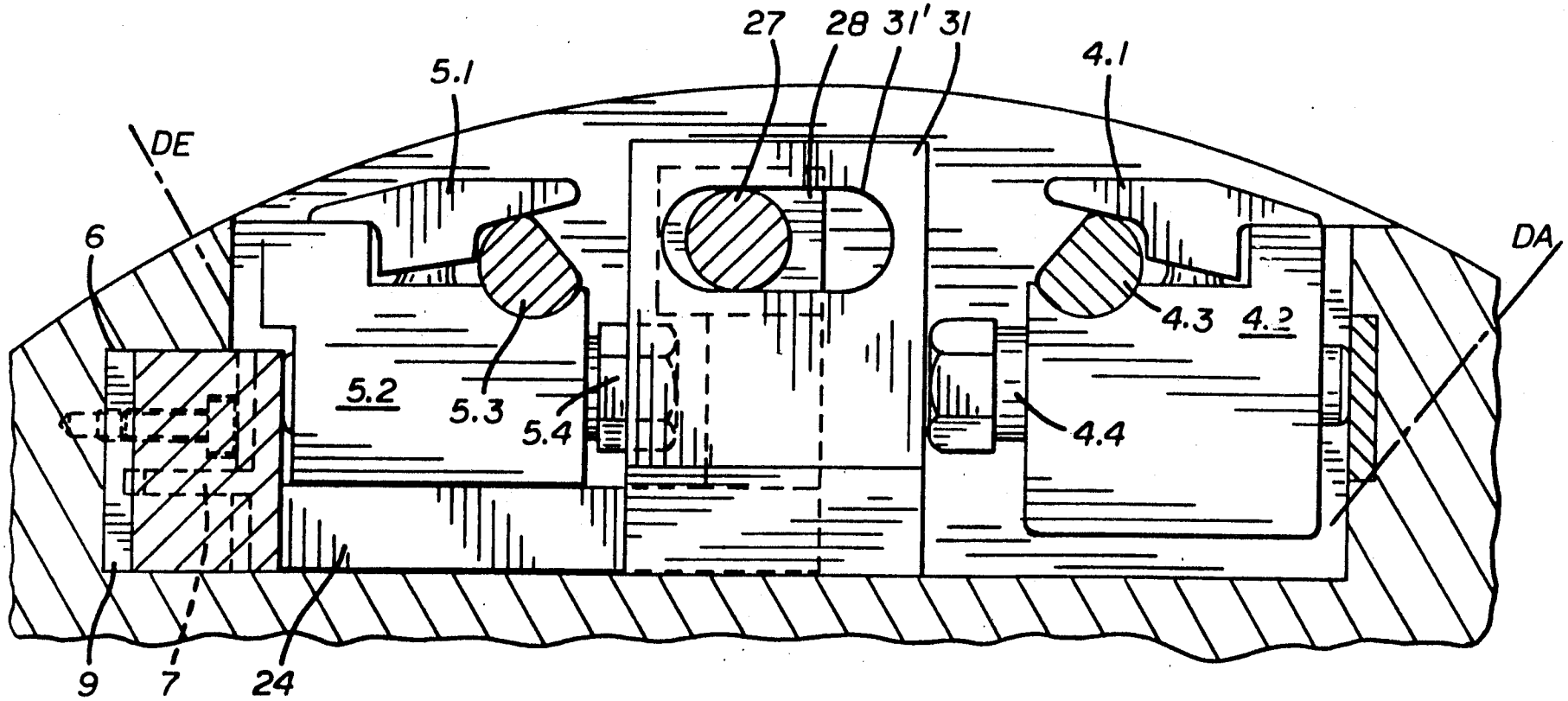

FIG. 5 is an enlarged simplified section taken along the line A–B of FIG. 3.

Figure 6:
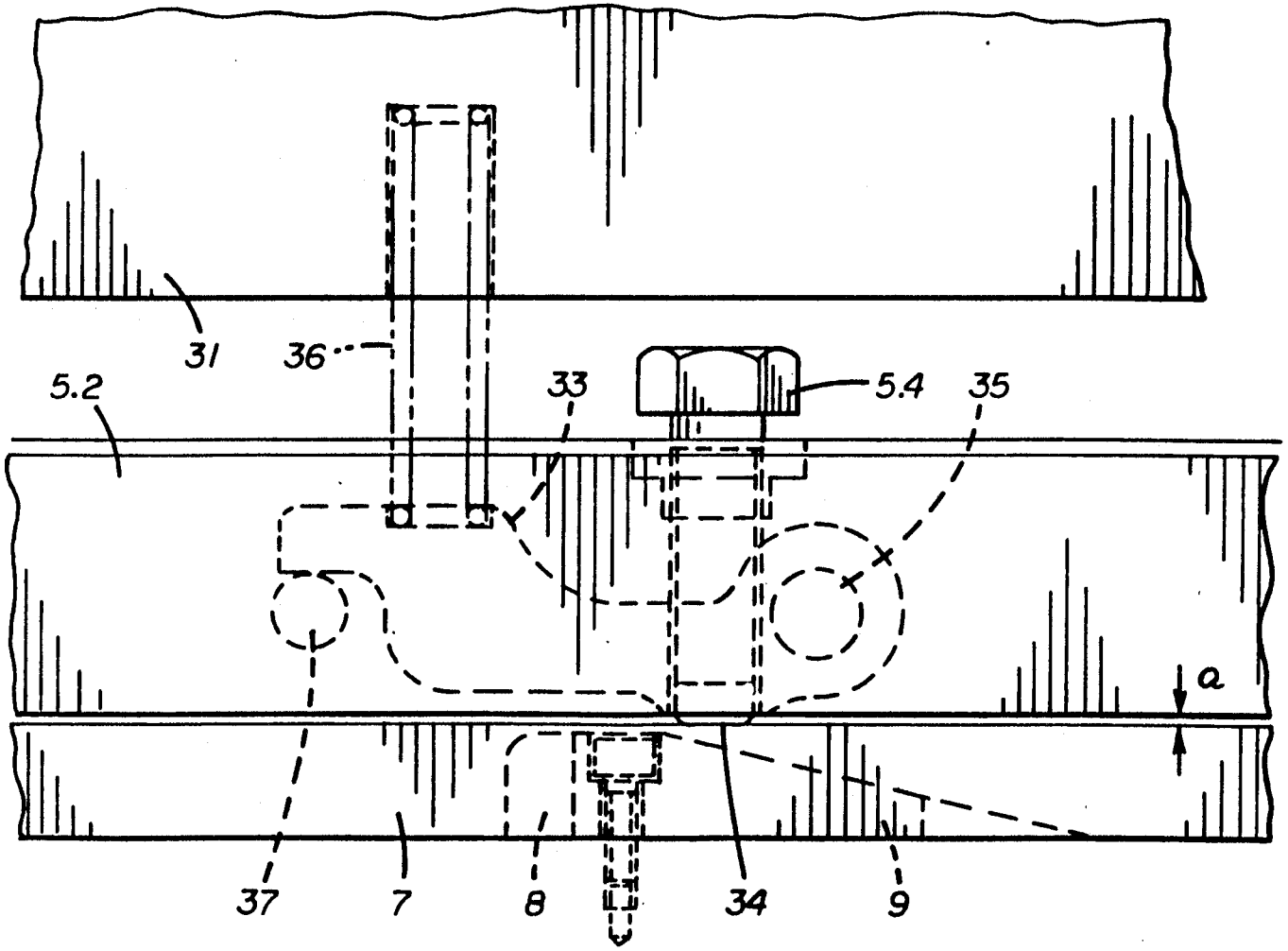

FIG. 6 is an enlarged detail of the plate tensioning arrangement.

Figure 7:
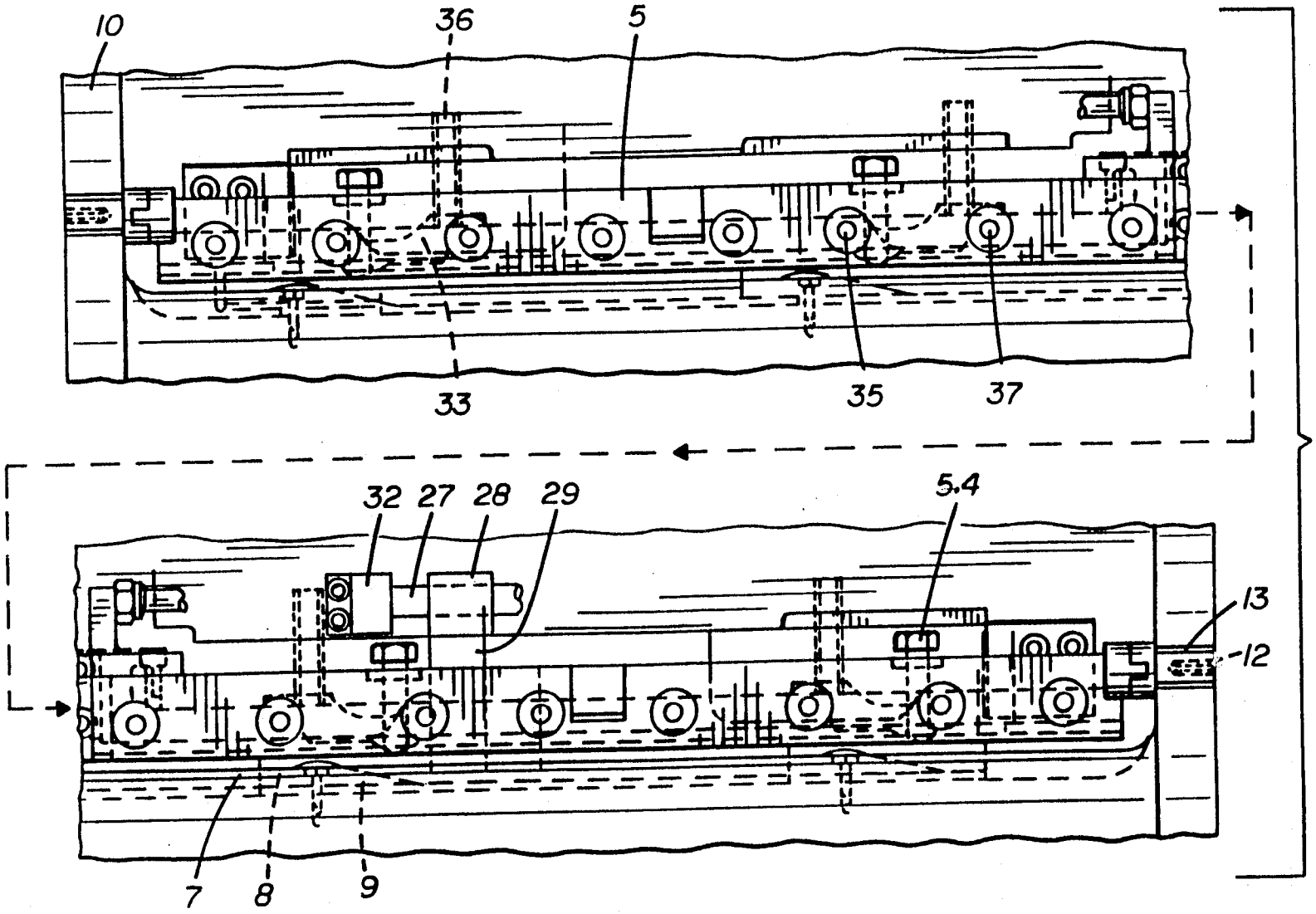

FIG. 7 is a general view of the rear tensioning bar.

DETAILED DESCRIPTION OF THE PREFERRED EMBODIMENT

The plate cylinder 1 is supported in bearings (not shown) on both sides in frame walls 2 of the printing machine. The cylinder gap 3 comprises means for clamping and tensioning printing plates. According to FIGS. 1, 3 and 5, these means are constructed in the form of front and rear tensioning bars 4, 5 associated with the start DA and the end DE of the print, each consisting of a top clamping device 4.1, 5.1, a bottom clamping device 4.2., 5.2 and operable by cam shafts 4.3, 5.3. The bars 4, 5 may be divided or undivided. The front tensioning bar 4 bears via tensioning screws 4.4 directly against the wall of the cylinder gap 3. The printing plate is fixed in a zero position in known manner in the front bar 4, e.g., by means of locating pins.

The rear tensioning bar 5 bears via tensioning screws 5.4 on a movable pressure strip 7 extending parallel to the rear gap wall in a recess 6 formed there.

The pressure strip 7 has two superimposed recesses 8 with an inclined plane, which slide on wedge surfaces on coacting members 9 so that a movement of the pressure strip 7 parallel to the gap wall causes the printing plate to be tensioned by the tensioning bar 5 moving from the rear gap wall. The prior art tensioning system described thus represents a series circuit consisting of a preliminary tensioning system (pressure strip 7, recesses 8, and coacting members 9) and the tensioning screw 5.4 for the final adjusting tensioning.

Figure 1:
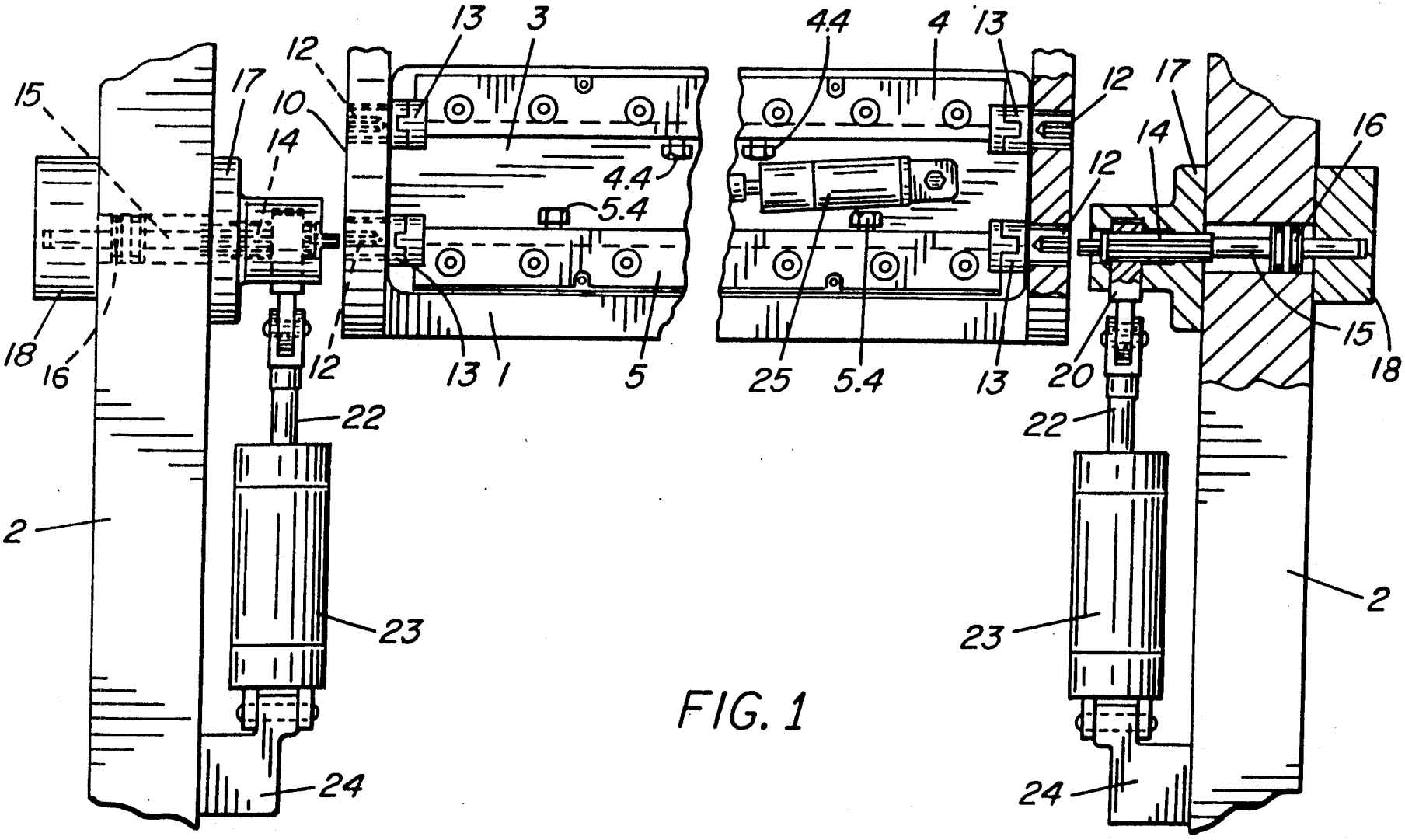
FIG. 1 shows a plate cylinder and a clamping device fixed to the frame in accordance with the invention.
Figure 2A:
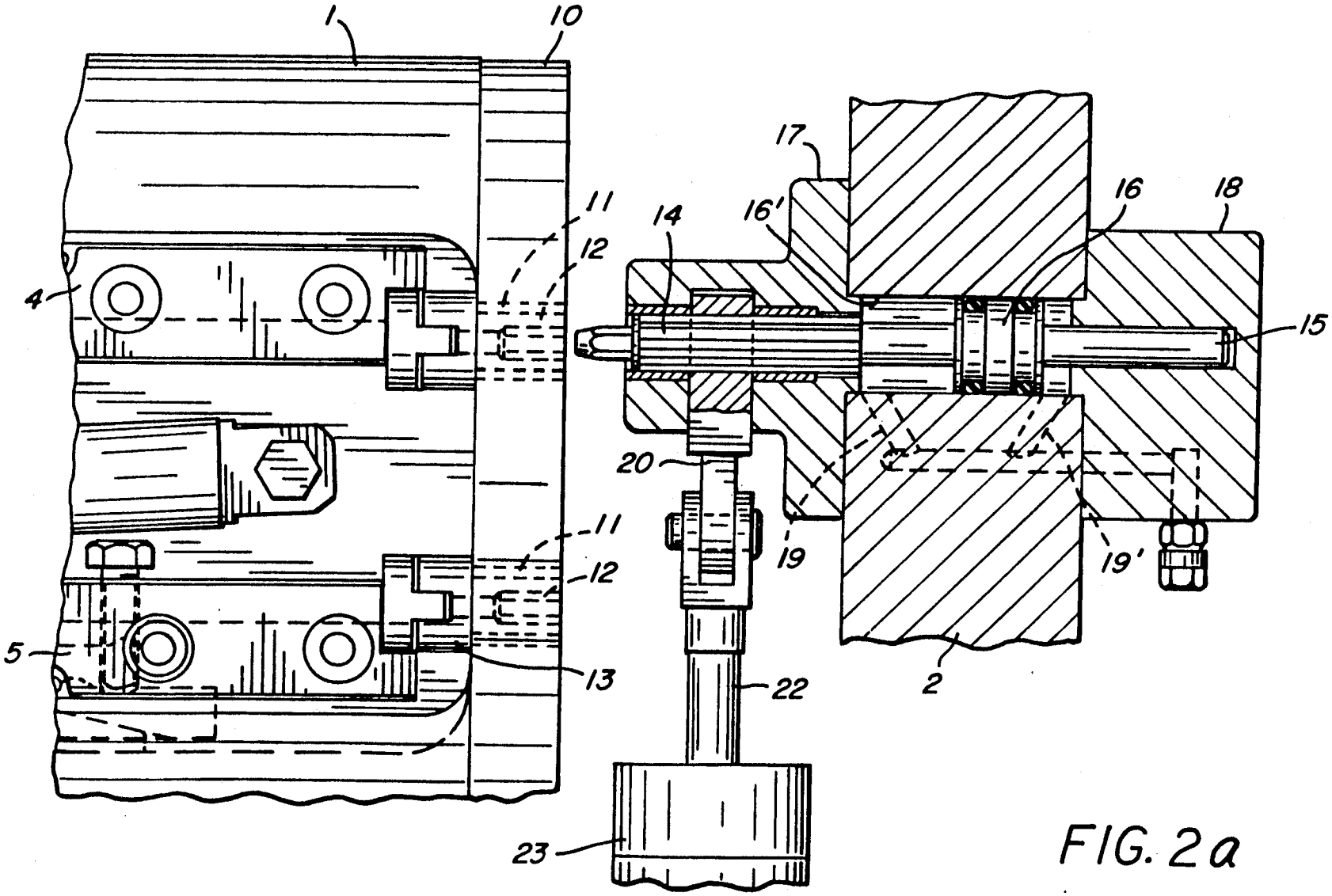

As shown in FIGS. 1 to 3, the camshafts 4.3, 5.3 have coupling sleeves 12 in both cylinder side walls 10 in openings 11 therein, such sleeves advantageously being flush with the cylinder side walls 10. The openings 11 in the cylinder side walls 10 are so dimensioned as to ensure maximum adjustability of the tensioning bars 4, 5, more particularly by the tensioning screws 4.4, 5.4 (FIGS. 2 and 3).

In order that the axial movability of the tensioning bar 4, 5 by the tensioning screws (not shown) should not simultaneously cause axial movement of the coupling sleeves 12, the camshafts 4.3, 5.3 are connected to the coupling sleeves 12 via compensating couplings 13, more particularly of the Oldham type.

With the same spacing as that of the camshafts 4.3, 5.3 and the coupling sleeves 12 connected thereto have from the axis of the plate cylinder 1, clamping tools 14 for rotating the camshafts and actuating the clamping devices 4.1 and 5.1 are movably recessed from the plate cylinder in the two frame walls 2. If the plate cylinder 1 is in the appropriate angular position, the clamping tools can be engaged in the coupling sleeves 12 of the print start and print end camshafts 4.3, 5.3 by an axial movement. The end of the clamping tool 14 engaging in the coupling sleeve 12 is of positive construction with respect to the inner profile of the coupling sleeve 12. More particularly, the coupling sleeve 12 has an internal hexagon and the end of the clamping tool 14 has an external hexagon profile. The latter may also additionally taper as shown in FIG. 2.

The rear part of the clamping tool 14 pointing away from the plate cylinder 1 is constructed as a piston rod 15 with a piston disc 16 which in turn is guided in a cylinder bore 16' in the frame wall 2 (FIG. 2). On the inside of the machine, the cylinder bore 16' defines a flange 17 which is fitted to the frame wall 2 and, on the outside of the machine, the cylinder bore 16' is defined by a bearing part 18 fitted to the frame wall 2. A flange 17 guides the shank or front part of the clamping tool 14. The bearing part 18 guides the end of the piston rod 15 in a bore. The part of the clamping tool 1 in the frame wall 2 thus forms together with the piston rod 15, piston disc 16, flange 17, and bearing part 18, a fluid-operated actuator in the form of a double-acting working cylinder, i.e., one movable in two directions by the application of pressure medium. The pressure medium is supplied to the two chambers of the working cylinder via bores 19, 19'. The pressure medium is advantageously compressed air. The flange 17 and the bearing part 18 have corresponding seals opposite the frame wall 2 and the clamping tool 14.

Figure 2B:
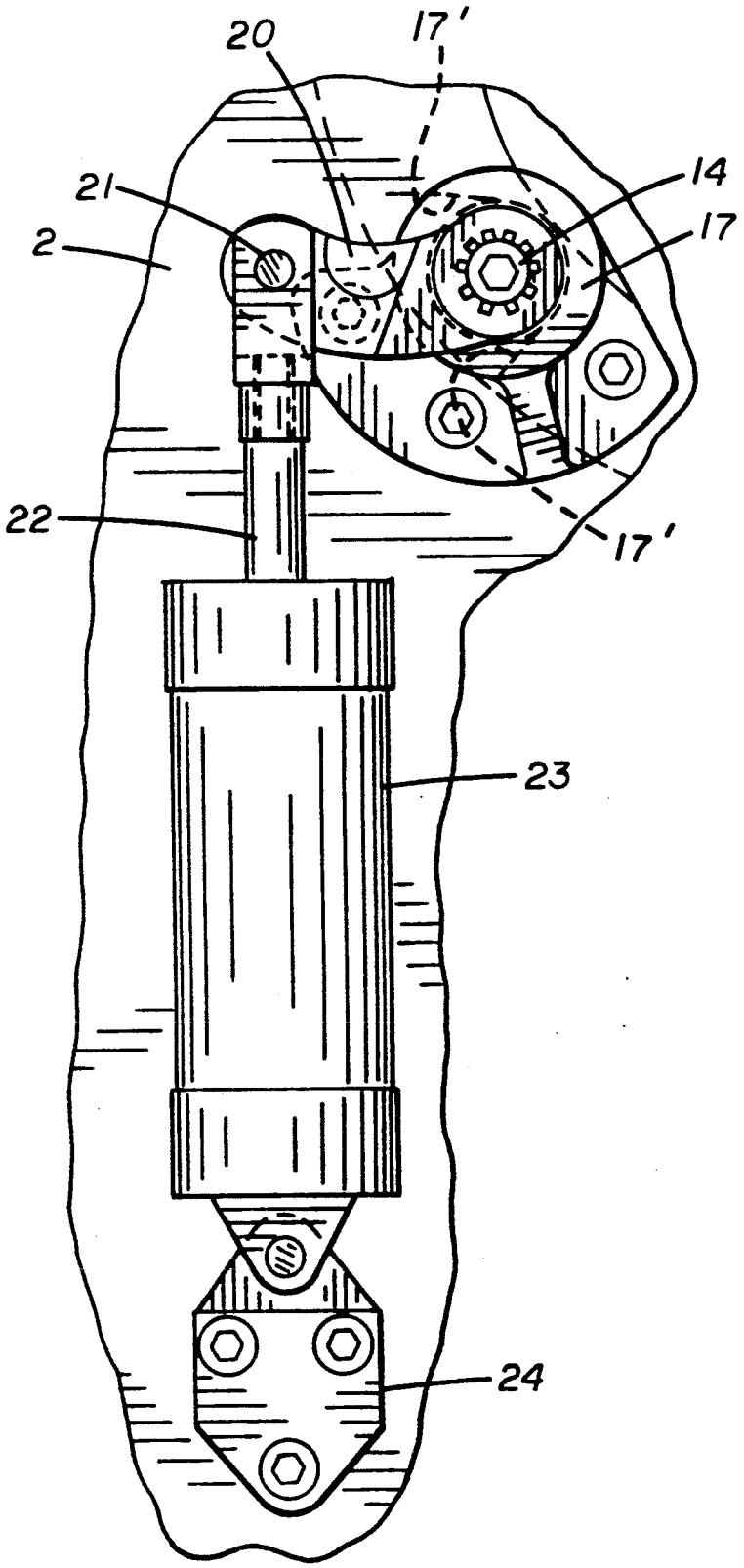

The front part of the clamping tool 14 constructed as a shank is additionally guided in the flange 17 by a bore of a lever 20. This bore and the shank of the clamping tool 14 are positively connected for rotation but so as not to impair the axial mobility of the clamping tool 14. More particularly, the bore and the shank have a multi-groove or splined profile. The flange 17 guides the lever 20 so that it can pivot while the free end of the lever 20 is taken out through an opening 17' (FIG. 2*b*) in the flange. The end of the lever 20 taken out of the flange 17 is connected via a joint 21 to a piston rod 22 of a fluid-operated actuator which also is a double-acting compressed air cylinder 23, the base of which is connected by a pivot boss via a bridge 24 firmly to the frame wall 2 (FIGS. 1 and 2*b*). Advantageously, the two compressed air cylinders 23 are installed in the machine in a predominantly vertical orientation since this gives the most space. By appropriate application of compressed air to the cylinders 23 with the clamping tools 14 engaged on both sides in the coupling sleeves 14 of the print start and print end camshafts 4.3, 5.3, the camshafts may be rotated to actuate the clamping devices 4.1 and 5.1 and thus the printing plate can be clamped and unclamped at the start and end of the print. Engagement and disengagement of the clamping tools 14 is, as already stated, carried out after appropriate angular positioning of the plate cylinder 1 relative to the tools.

A motor 25 is disposed in the gap 3 of the plate cylinder 1 between the front and rear tensioning bars 4, 5 and, by way of a joint 26, drives a spindle 27 extending parallel to the axis of the plate cylinder 1. A nut 28 is disposed on the spindle 27 and is securely connected to the pressure strip 7 via a bridge 29. The spindle 27 is guided in the manner of a shaft through a supporting wall 31 by means of an axial thrust bearing 30 and bears at its end by a spherical end face via a thrust member 32 against another supporting wall 31 so as to be fixed to the print cylinder 1 (FIGS. 3 and 4).

Depending on the direction of rotation of the motor 25, the spindle nut 28 and hence also the pressure strip 7 are moved parallel to the rear wall of the cylinder gap 3 via the spindle 27 supported on both sides. Since the spindle 27 moves parallel to the pressure strip 7, the axial thrust bearing 30 is recessed into a corresponding groove 31' in the supporting wall 31 (FIG. 5). To be able to follow the movement of the spindle 27, the motor 25 is pivotally mounted (FIGS. 3 and 4) at its rear end by means of a joint 25' so as to pivot parallel to the base of the cylinder gap 3. The motor 25 is advantageously a compressed air motor, more particularly a laminations type motor. Appropriate admission of compressed air to the motor 25 readily prevents any overstretching or cracking of the printing plate during tensioning. The compressed air supply for operation of the motor 25 in both directions of rotation is effected in a manner not shown, by means of a torque transmitter via a journal of the plate cylinder 1 and the frame wall 2 supporting it.

Beneath the rear tensioning bar 5, which is more particularly divided, and hence beneath the lower clamping device 5.2, a tensioning lever 33 is associated with each tensioning screw 5.4 along the bearing surface of the pressure strip 7 (FIGS. 3 and 6). Particularly in the case of a divided rear tensioning bar with two tensioning screws 5.4 in each case, and hence a total of four tensioning levers 33, they are advantageously arranged in mirror-image symmetry with respect to the center of the plate cylinder 1 (FIG. 7).

Each tensioning lever 33 is supported on the pressure strip 7 via an integrally formed lug 34 with a power-boosting lever transmission. One end of each of the tensioning levers 33 is connected by a swivel joint 35 to the rear tensioning bar 5, i.e., the lower clamping device 5.2. The other free end of the tensioning lever 33 is supported on an abutment pin 37 via a spring 36 supported so as to be fixed to the cylinder. The pin 37 lies on the line connecting the swivel joints 35 in the rear tensioning bar 5. There is, therefore, a gap a (FIGS. 6 and 7) between the pressure strip 7 and the lower clamping device 5.2.

If the pressure strip 7 is now moved in the direction for tensioning of the end of the print by way of the motor 25 and spindle 27, the rear tensioning bar 5 is first pushed forward via the lugs 34 of the tensioning levers 33. As a result of regulation of the tensioning of the springs 36, uniform tensile forces are circumferentially exerted on the clamped printing plate via the tensioning bar 5.

If a specific tensioning force is exceeded, depending on the biasing and characteristic of the springs 36 and also the transmission of the tensioning levers 33, the free ends of the tensioning levers 33 pivot away from the abutment pin 37. The tensioning force exerted on the printing plate can be limited in this way and also automatic re-tensioning in order to maintain the tensile force is possible.

Circumferential register correction is then carried out in known manner by way of the tensioning screws 4.4, 5.4 axially by means of set screws indicated in FIG. 7, more particularly in the center of the plate cylinder 1.

We claim:

1. An arrangement for use in a printing machine having a plate cylinder with a cylinder gap having front and rear gap walls, said cylinder having side walls, frame walls adjacent said side walls and rotatably supporting said cylinder, front and rear tensioning bars located in said gap and movable substantially in the circumferential direction of said cylinder, each of said bars having a top and bottom clamping device and each having a rotatable cam shaft for operating said top clamping device, front tensioning screws connected to said front bar and bearing against said front gap wall whereby adjustment of said front screws results in substantially circumferential movement of said front bar, a pressure strip extending parallel to said rear gap wall, rear tensioning screws connected to said rear bar and bearing against said pressure strip whereby adjustment of said rear screws results in substantially circumferential movement of said rear bar, said pressure strip being formed with recesses having inclined surfaces, axially fixed members having wedge surfaces which coact with said inclined surfaces to move said pressure strip substantially circumferentially in one direction when said pressure strip is moved axially in one direction, and a central actuating device for moving said pressure strip axially whereby the pressure strip and the rear bar are moved substantially circumferentially for quick-action tensioning, the improvement comprising, coupling sleeves on the ends of said camshafts, openings formed through said side walls of said cylinder, said coupling sleeves being located in said openings, tools for rotating said cam shafts and thereby operating said top clamping devices, said tools being slidably and rotatably supported by said frame walls and having end portions positioned to telescope non-rotatably with said coupling sleeves, first fluid-operated actuators for advancing said tools into and for retracting said tools out of telescoped relation with said coupling sleeves when said cylinder is in a predetermined angular position, a lever slidably and non-rotatably connected to each tool and operable when rocked to rotate the tool, and second fluid-operated actuators connected to said levers and selectively operable to rock said levers.

2. An arrangement as defined in claim 1 in which each of said first fluid-operated actuators comprises a cylinder, a piston slidable in said cylinder, and a rod connected to said piston, said cylinders being formed by bores in said frame walls, and first and second bearings on opposite sides of each of said frame walls, said first and second bearings slidably supporting said tool and said rod, respectively.

3. An arrangement as defined in claim 2 in which each of said first bearings is formed with an opening in one side thereof, each of said levers having a portion received in the opening of the respective bearing and captivated axially by the bearing.

4. An arrangement as defined in claim 1 in which said first and second actuators are double-acting pneumatic actuators.

5. An arrangement as defined in claim 1 further including a compensating coupling between each camshaft and each coupling sleeve.

6. An arrangement as defined in claim 1 further including a motor disposed in said cylinder gap, a threaded spindle connected to be rotated by said motor, a nut movable axially along said spindle in response to rotation thereof, and means rigidly connecting said nut to said pressure strip.

7. An arrangement as defined in claim 6 in which said motor is a rotary air-operated motor.

8. An arrangement as defined in claim 6 further including a thrust bearing, one end of said spindle being formed with a spherical end face disposed in engagement with said thrust bearing.

9. An arrangement as defined in claim 1 further comprising a tensioning lever associated with each rear tensioning screw and located along said pressure strip beneath said rear tensioning bar, a lug integral with each lever and bearing against said pressure strip, a joint pivotally connecting one end of each lever to said rear bar, a fixed abutment pin associated with each lever, spring means fixed to said cylinder and urging the free end of each lever into bearing engagement with the respective abutment pin, movement of said pressure strip axially in said one direction by said actuating device causing the free ends of said levers to pivot away from said abutment pins and effecting loading of said spring means.

* * * * *